US006615716B1

(12) United States Patent
Freddo et al.

(10) Patent No.: US 6,615,716 B1
(45) Date of Patent: Sep. 9, 2003

(54) MULTI-COLOR FLEXOGRAPHIC ROTARY MACHINE WITH MAIN DRUM AND INDEPENDENT SEPARATE COLOR UNITS

(75) Inventors: Giovanni Freddo, San Martino Buon Albergo (IT); Agostino Pertile, San Martino Buon Albergo (IT)

(73) Assignee: Uteco S.p.A. Roto-Flexo & Converting, Colognola Ai Colli (IT)

( * ) Notice: Subject to any disclaimer, the term of this patent is extended or adjusted under 35 U.S.C. 154(b) by 0 days.

(21) Appl. No.: 09/641,522

(22) Filed: Nov. 6, 2000

Related U.S. Application Data

(62) Division of application No. 09/298,833, filed on Apr. 26, 1999, now Pat. No. 6,125,752.

(30) Foreign Application Priority Data

May 5, 1998 (IT) ..... VR98A0037

(51) Int. Cl.[7] ..... B41F 27/00
(52) U.S. Cl. ..... 101/216; 101/479
(58) Field of Search ..... 101/216, 212, 101/218, 219, 477, 479, 480, 153, 375

(56) References Cited

U.S. PATENT DOCUMENTS

| | | | | | |
|---|---|---|---|---|---|
| 1,379,818 | A | | 5/1921 | Hinnekens | |
| 3,039,387 | A | * | 6/1962 | Zimmer et al. | 101/216 |
| 3,789,757 | A | * | 2/1974 | Motter et al. | 101/216 |
| 3,859,919 | A | * | 1/1975 | Skrypek et al. | 101/350.3 |
| 4,697,516 | A | | 10/1987 | Rombout | |
| 4,901,641 | A | * | 2/1990 | Steiner et al. | 101/216 |
| 5,010,813 | A | * | 4/1991 | Buffo | 101/216 |
| 5,101,726 | A | * | 4/1992 | Lübke et al. | 101/216 |
| RE33,944 | E | | 6/1992 | Knauer | |
| 5,241,905 | A | * | 9/1993 | Guaraldi et al. | 101/216 |
| 5,275,105 | A | * | 1/1994 | Schweizer et al. | 101/216 |
| 5,289,769 | A | | 3/1994 | Lewis | |
| 5,370,047 | A | | 12/1994 | Compton | |
| RE34,970 | E | | 6/1995 | Tittgemeyer | |
| 5,457,520 | A | | 10/1995 | Schell et al. | |
| 5,617,789 | A | | 4/1997 | Achelpohl et al. | |
| 5,746,132 | A | * | 5/1998 | Parks et al. | 101/218 |
| 5,832,829 | A | | 11/1998 | Kolbe et al. | |

FOREIGN PATENT DOCUMENTS

| | | |
|---|---|---|
| CH | 614177 | 11/1979 |
| EP | 0 741 017 | 11/1996 |

* cited by examiner

*Primary Examiner*—Eugene H. Eickholt
(74) *Attorney, Agent, or Firm*—Guido Modiano; Albert Josif; Daniel O'Byrne

(57) ABSTRACT

A flexographic rotary printing machine has a supporting structure provided with two lateral shoulders, an impression roller over which a material in sheet form to be printed passes, at least one printing element or assembly arranged adjacent to the impression roller and having an inking unit, a printing plate cylinder and an anilox roller, which are sleeve cylinders, and a drive for transmitting motion between the impression roller and each printing assembly. At each shoulder there is at least one lateral support device for the advancement-retraction of the sleeve cylinders, adapted to move them between a retracted or resting position, in which a respective sleeve can be inserted or removed, and an advanced or active position, in which the cylinders are kept in contact with, and operatively connected to, the impression roller.

4 Claims, 11 Drawing Sheets

MULTI-COLOR FLEXOGRAPHIC ROTARY MACHINE WITH MAIN DRUM AND INDEPENDENT SEPARATE COLOR UNITS

This application is a division of U.S. application Ser. No. 09/29883 filed Apr. 26, 1999 and now U.S. Pat. No. 6,125,752.

BACKGROUND OF THE INVENTION

A The present invention relates to a multi-colour rotary flexographic machine of the narrow-web type.

As it is known, replacement of the printing plate cylinder and the anilox roller in each printing unit of a conventional flexographic rotary machine is a troublesome operation which requires long machine downtimes.

SUMMARY OF THE INVENTION

The main object of the present invention is to provide a new flexographic rotary machine with separate printing units in which changing of printing and/or printing colours can be made in a quick and easy way.

Another object of the present invention is to provide a high performance flexographic rotary machine which is highly reliable and precise.

These and other objects which will become better apparent hereinafter are achieved by a flexographic rotary printing machine according to the invention, which comprises a supporting structure, an impression roller on which a sheet material to be printed passes, at least one printing unit arranged adjacent to said impression roller and having a closed-chamber doctor-blade inking group, a printing plate cylinder and an anilox roller, which are of sleeve cylinder type, motion transmission means between said impression roller and each printing assembly, and at least one lateral support device for forward and backward movements of said sleeve cylinders which is arranged to move them between a retracted or resting position, in which a respective sleeve can be inserted or removed, and an advanced or printing position, in which they are kept in contact with, and operatively connected to, said impression roller.

Advantageously, said lateral support device comprises at least one slide provided with recirculating ballscrew sliding blocks and a guide of antifriction material.

BRIEF DESCRIPTION OF THE DRAWINGS

Further aspects and advantages of the present invention will become better apparent from the following detailed description of a currently preferred example of embodiment thereof, given merely by way of non-limitative example with reference to the accompanying drawings, wherein.

DESCRIPTION OF THE PREFERRED EMBODIMENTS

Figure 1:
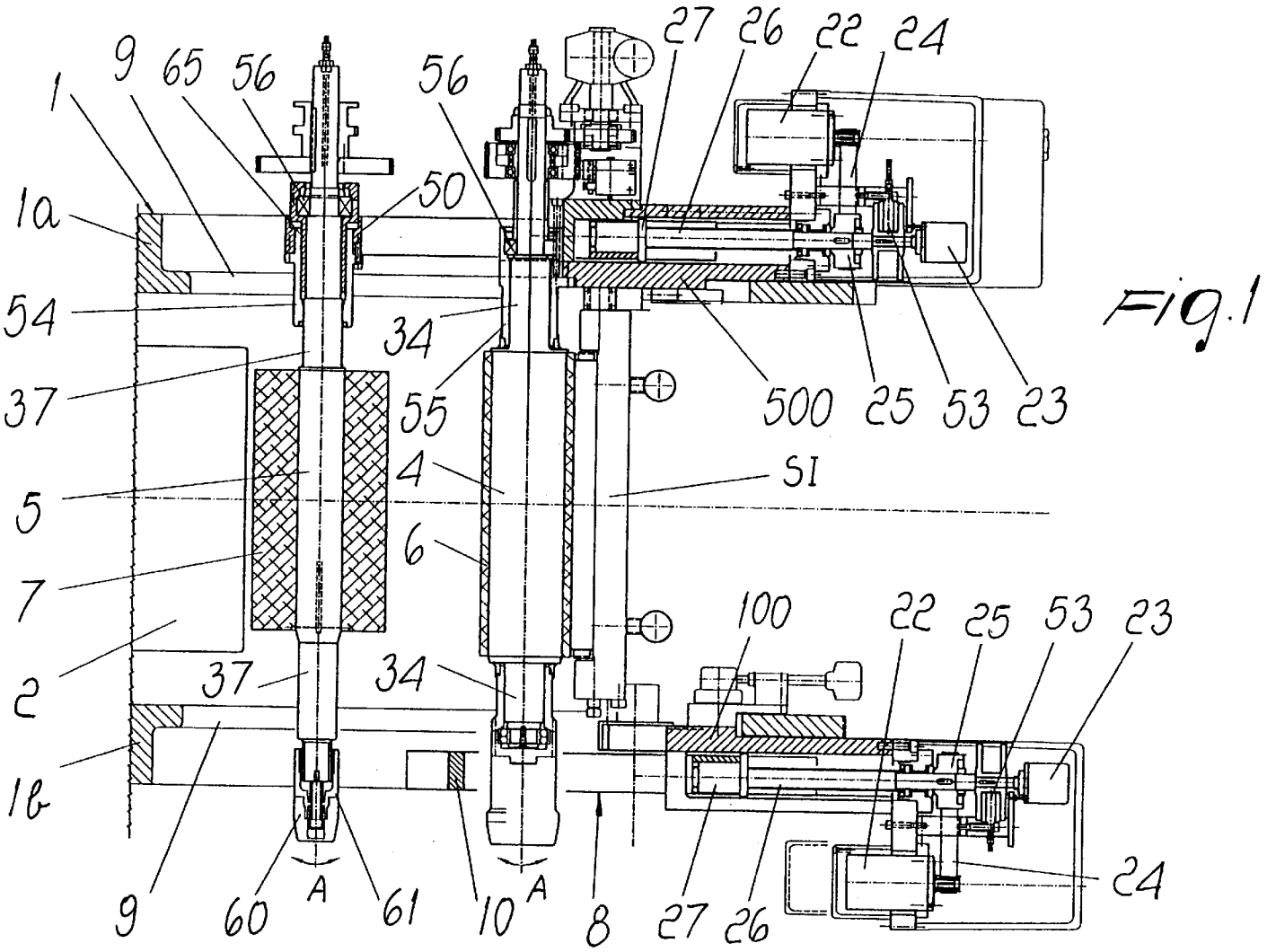
FIG. 1 is a schematic top view, with parts shown in cross-section along the line I—I of FIG. 2, of a colour unit arranged adjacent to the impression roller of a printing machine according to the invention.
Figure 2:
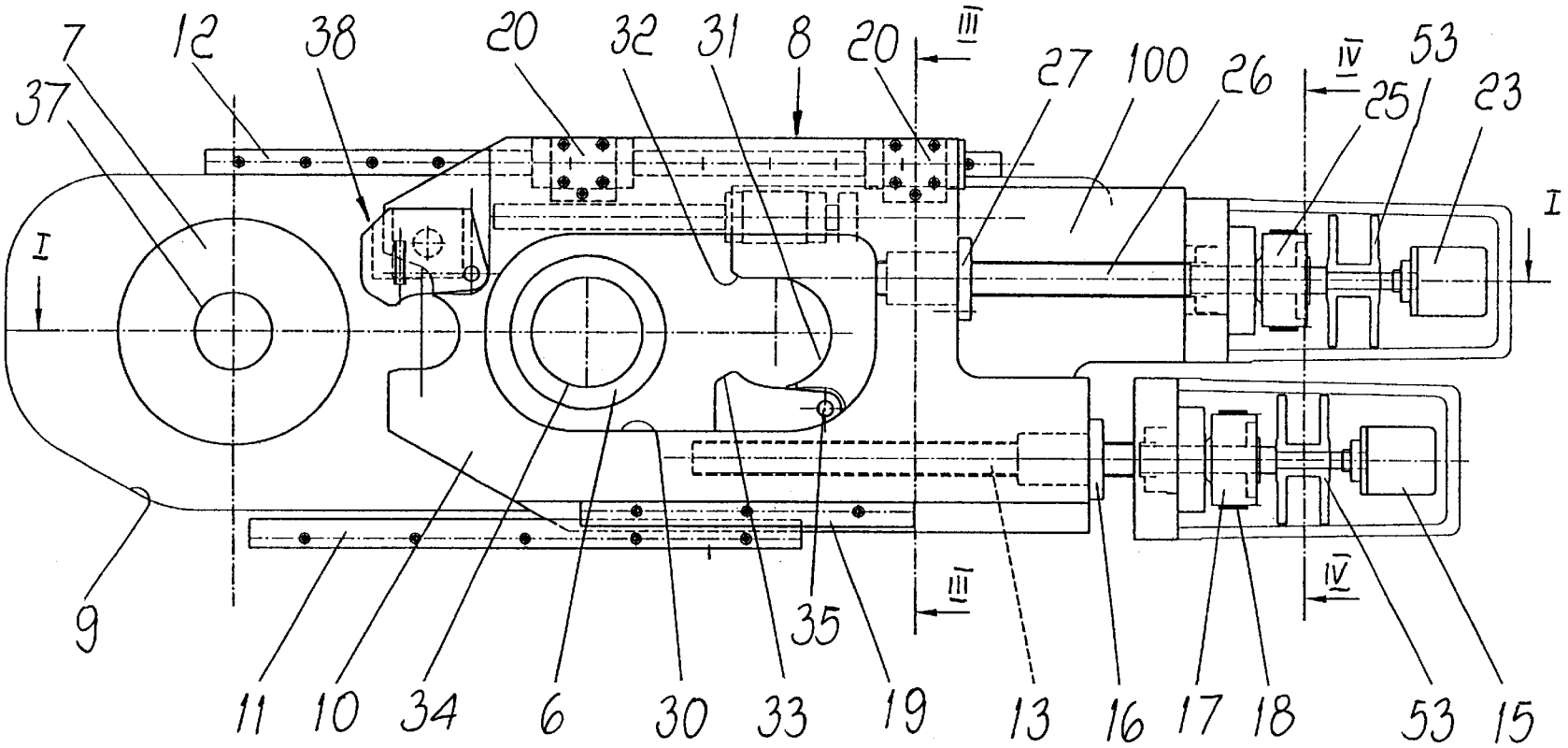
FIG. 2 is a front side view on an enlarged scale of the colour unit of FIG. 1.
Figure 4:
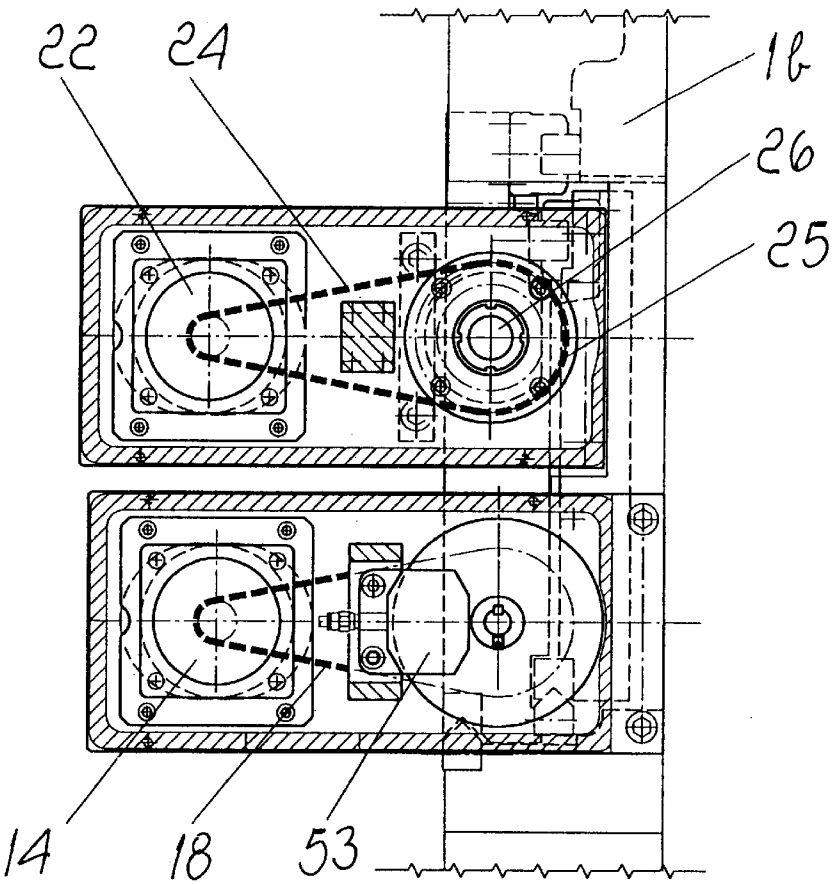
FIG. 4 is a cross-section view taken along the line IV—IV of FIG. 2.
Figure 3:
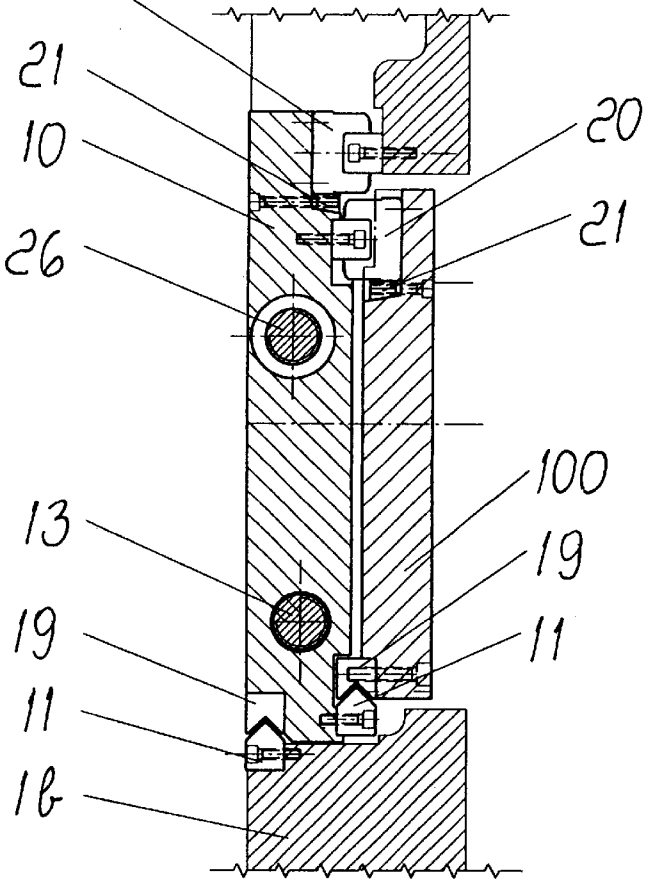
FIG. 3 is a cross-section view taken along the line III—III of FIG. 2.
Figure 5:
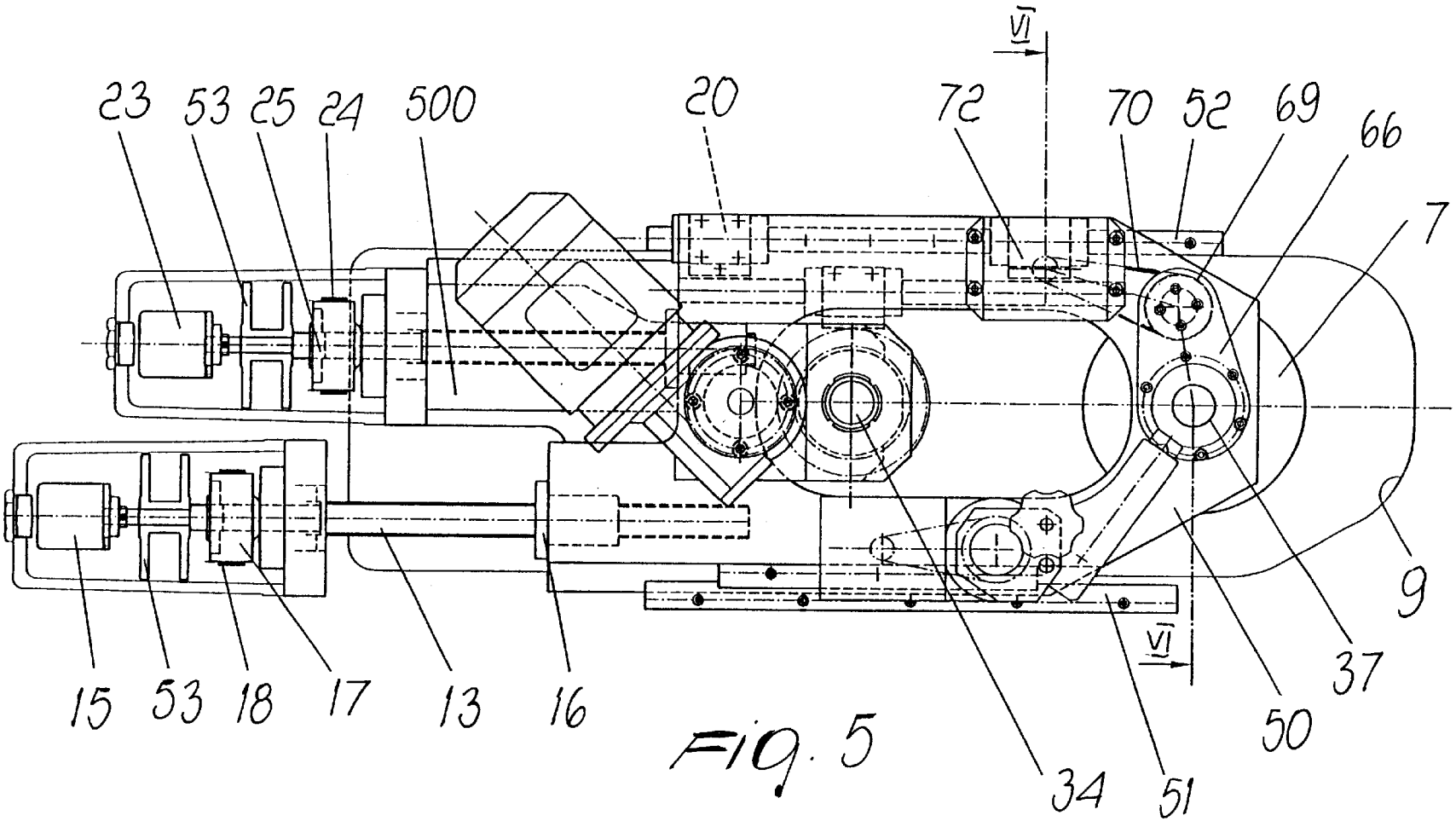
FIG. 5 is rear side view on an enlarged scale of the colour unit of FIG. 1.

In the accompanying drawings, identical or similar parts or components have been designated by the same reference numerals.

With reference to FIGS. 1 to 10 and 15, it will be noted that a printing machine according to the invention has a supporting structure, generally designated by the reference numeral 1. An impression roller or printing drum 2, around which a sheet or web material to be printed passes and is partly wound, is mounted for rotation on the structure 1. On the opposite side with respect to the vertical axis of the impression roller 2 there is provided a plurality of printing assemblies or color units 3, e.g. eight printing units, which extend substantially in radial direction with respect to the impression roller.

The supporting structure 1 comprises in particular two cast-iron shoulders 1*a* and 1*b* of large thickness to ensure maximum stability and lack of vibrations and thus optimum printing quality control.

Each printing unit 3 comprises, as usual in the art, a closed-chamber doctor-type inking group, generally designated by SI, an anilox roller 4, and a printing plate cylinder 5, which can be operatively connected to each other and to the impression roller 2 by suitable motion transmission means, usually gears, as further explained hereinafter.

The printing plate cylinder 5 and the anilox roller 4 of each printing unit are sleeve cylinders, since engraving is also provided on a tubular element 6, whereby both the printing plate 7 and the tubular element 6 constitute "sleeves" insertable on, and removable from, a respective cylinder 5 or 4. This makes it possible to considerably simplify printing or color changing operations, since it is no longer necessary to replace the cylinders 4 and 5 but simply to change or replace their respective sleeves, which is a much simpler operation that can be performed in a very short time, as no heavy loads or loads which might be dangerous for the safety of the personnel and for the components of the machine need to be handled.

Each printing unit 3 has at one shoulder of the machine (preferably the front shoulder 1*b*) a supporting device, generally designated by the reference numeral 8, arranged to cause the sleeve cylinders 4 and 5 to move back and forward between a retracted or resting position, in which their respective sleeve 6, 7 can be inserted or removed, and an advanced or printing position, in which it is kept in contact and operatively connected to said impression roller.

More particularly, each supporting device 8 is mounted at a respective large opening or slot 9 formed in the front shoulder 1*b* of the printing machine for easy loading and unloading of the ceramic anilox sleeve 6 and the printing plate sleeve 7 of the sleeve cylinders 4 and 5. A supporting device 8 comprises a slide10, one or more lower linear prismatic guides 11 which are fixed to the supporting structure 1, an upper linear guide 12 for the linear sliding of the slide 10, and control means for actuating the slide 10, e.g. constituted by a screw 13 driven by an electric motor 14 supported by the shoulder 1*b* and controlled by a respective encoder 15, and by a female thread 16, secured to the slide10, the screw 13 being rotated by a wheel or pulley 17 which is keyed thereon and by a toothed transmission belt 18 which is driven by the motor 14.

Preferably, the or each prismatic guide 11 is engaged by a respective sliding block 19, which is fixed to the slide 10 and mates with the prismatic guide 11, and is constituted by a suitable antifriction material having a low coefficient of friction, e.g. a material commercially known as "Turcite" and marketed by Swedish company Shamban, which besides having a very low coefficient of friction can also absorb the vibrations that might occur during printing.

At its upper part, the slide 10 has two recirculating-ballscrew sliding blocks 20 to ensure good smoothness and high resistance to overturning moments which might occur during a sleeve changing operation.

To the side of the slide 10 there is a second slide or sliding block 100 which is designed to support the cylinder 4 and can be actuated by an assembly comprising an electric motor 22, an encoder 23, a toothed belt 24 and a pulley 25 and arranged to rotate a screw 26 in a female thread 27 carried by the slider 10.

At the upper guide 12 registering wedges 21 are also provided which are arranged to eliminate any play between the slider 10 and 100 and the shoulders of the supporting structure 1 and to apply a given preloading to the lower guide or guides 11, thereby ensuring greater and constant rigidity of the system during printing operations.

The slide 10 has a through slot 30 which extends longitudinally and parallel to the guides 11 and 12 and has such dimensions as to ensure easy passage of an anilox sleeve 6 for the anilox roller 4.

The distal end of the slide or sliding block 100 is equipped, i.e. it has a substantially semicircular receiving cradle or seat 31 whose inlet has chamfered edges 32 and 33 to constitute guiding surfaces for the entry of the end 34 of the end 4.

Advantageously, the lower portion of the cradle 31 is constituted by a separate part which is articulated at a pivot 35 which has a horizontal axis in order to resiliently yield and assist the inlet-exit of the end 34 into and from the cradle 31.

At the distal end of the slide 10, a recess 36 delimits a cradle or seat for receiving an end 37 of the cylinder 5. At the upper portion of the cradle 36 there is provided a removing holding device 38 which is further explained with reference to FIGS. 7 to 10.

Most of the upper portion of the cradle 36 is formed by a holding lever or cap element 39, which is articulated about a pivot 40 located in an upper region above the cradle 36, in a backward position close to the slot 30, thereby allowing the holding element 39 to oscillate on a plane parallel to the plane on which the slide10 moves.

Figure 8:
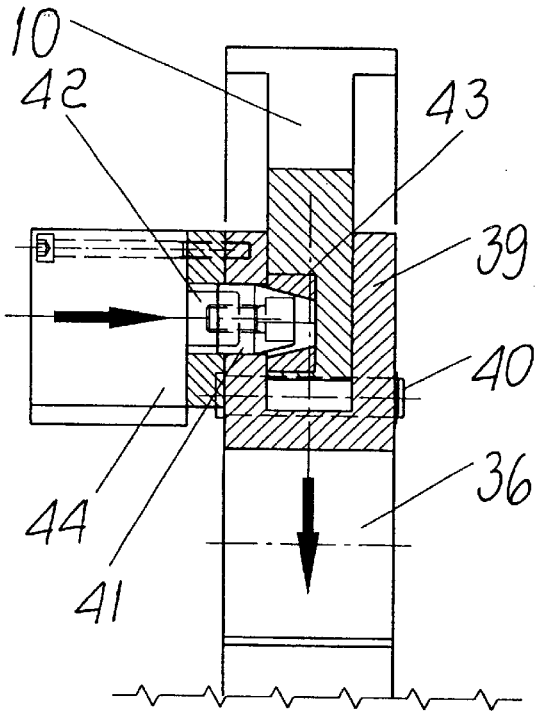
FIG. 8 is a cross-section view taken along the line VIII—VIII of FIG. 7.
Figure 9:
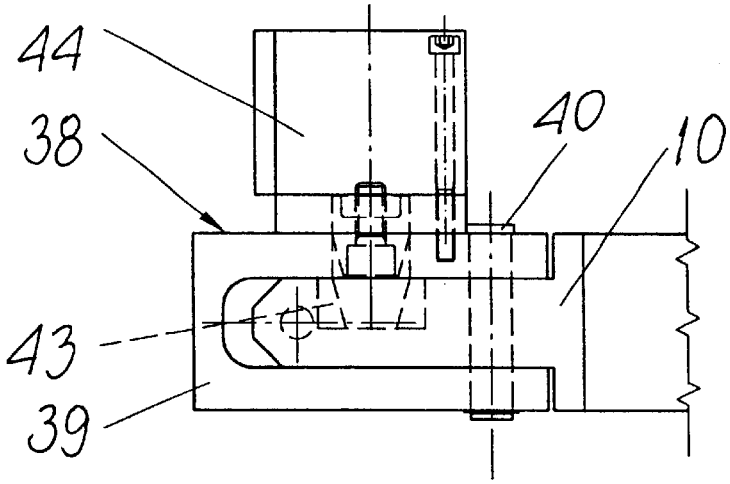
FIGS. 9 and 10 are a plan view and a side view, respectively, of the cap of FIG. 7 in its open position.
Figure 10:
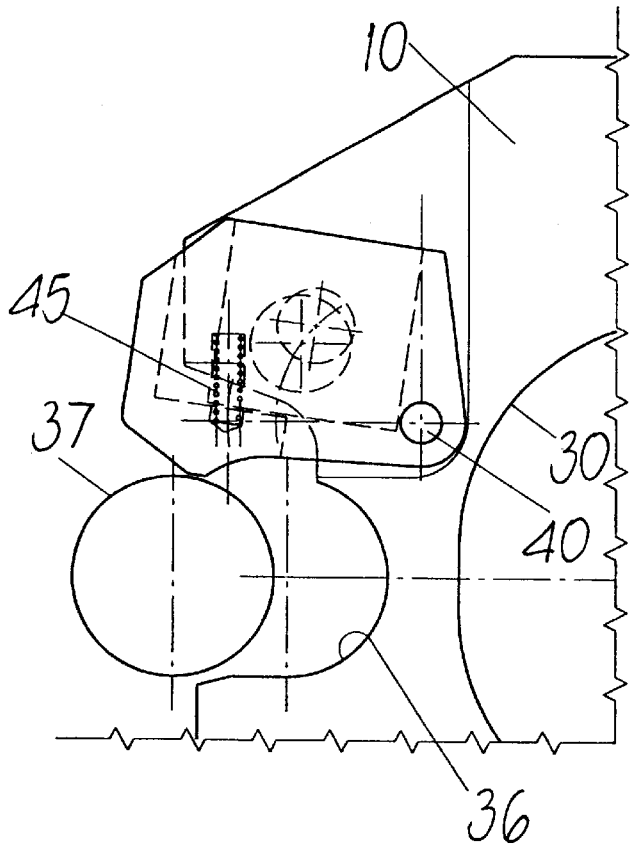
Figure 11:
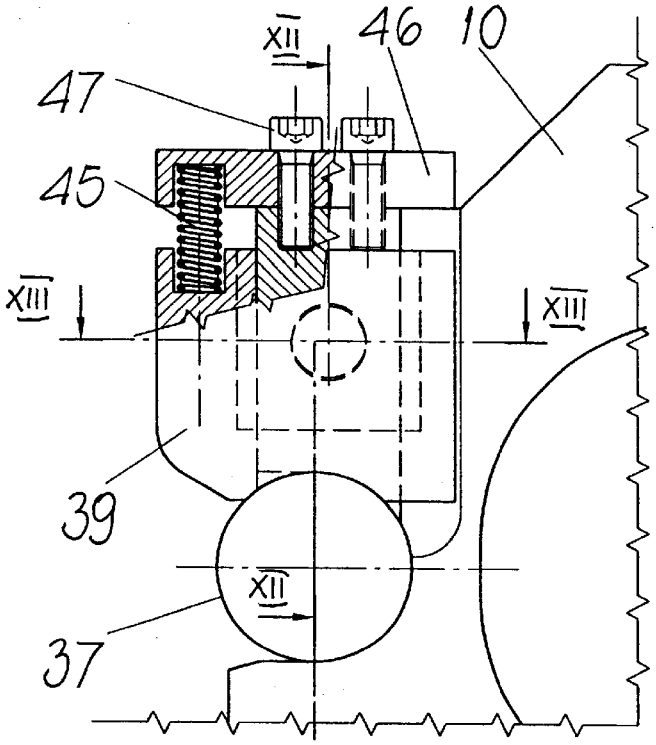
FIG. 11 shows another embodiment of a cap with a conical locking pin.
Figure 12:
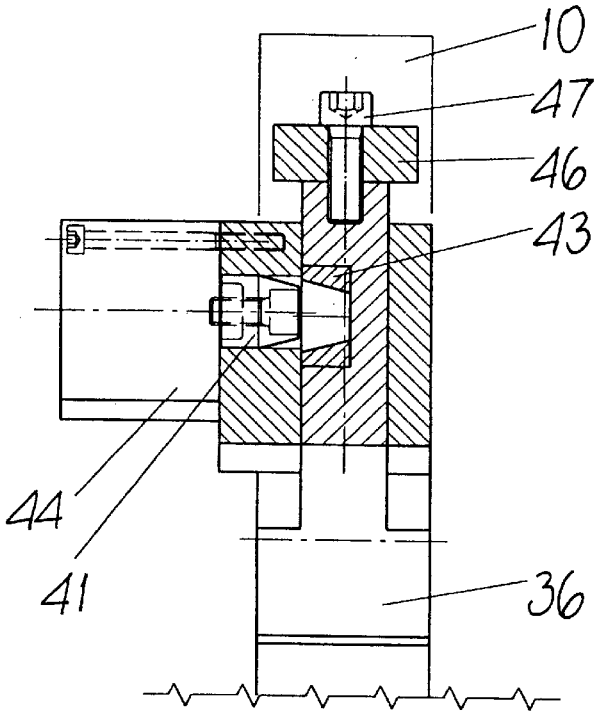
FIG. 12 is a cross-section view taken along the line XII—XII of FIG. 11.
Figure 13:
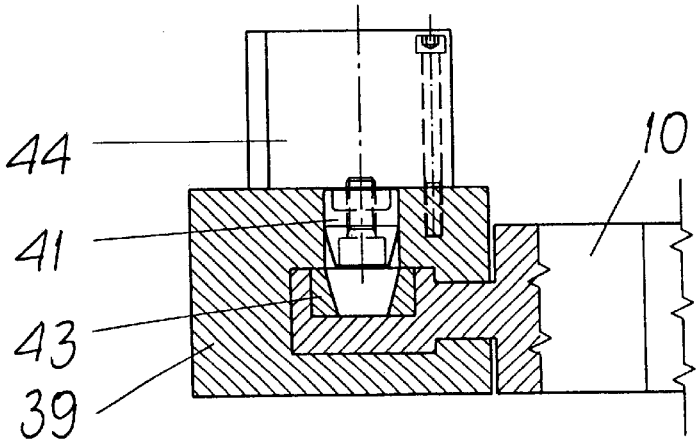
FIG. 13 is a cross-section view taken along the line XIII—XIII of FIG. 11.
Figure 14:
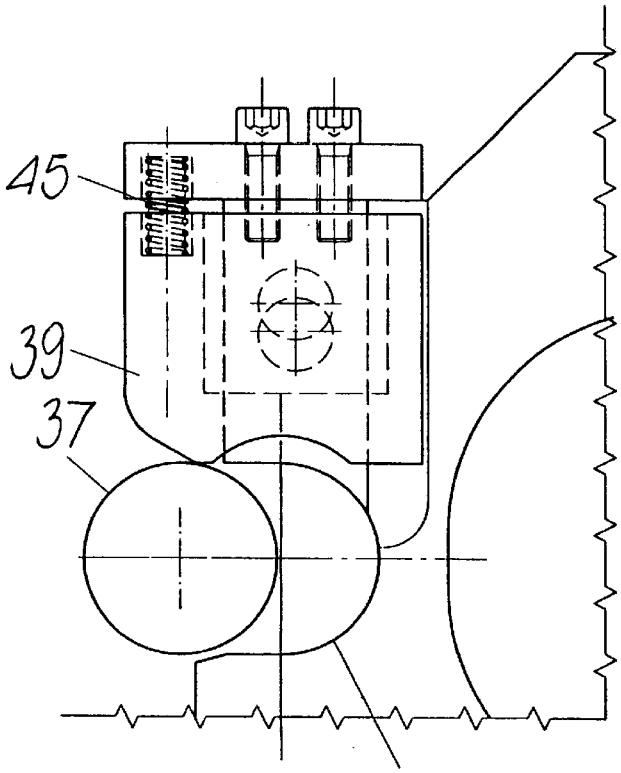
FIG. 14 is a side view of the cap of FIG. 11 in its open position.
Figure 15:
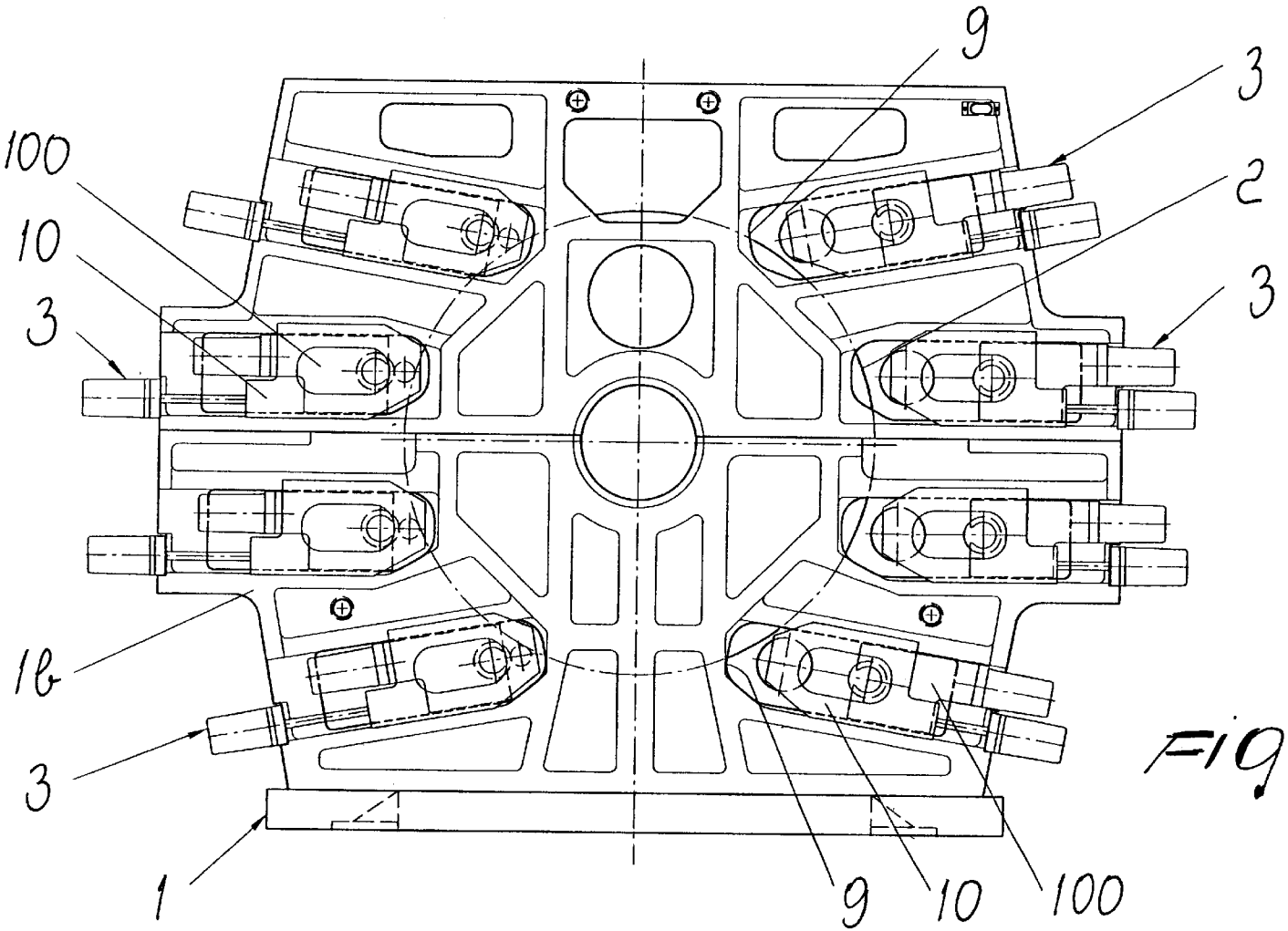
FIG. 15 shows a side elevation view of an eight-color rotary printing machine with a central drum.

As shown more clearly in FIG. 8, the holding element 39 can be a U-shaped in cross-section and is slidingly inserted from below onto the upper end of the cradle 36. Moreover, the lever element 39 is resiliently loaded, e.g. by one or more helical springs 45 which urge it to its closed position.

Articulation movements of the holding element 39 are prevented by an axially movable pivot 41 which has a frustum-shaped tip and is located in a lateral seat or recess 42 formed in one wing of the holding element and terminating with a frustum-shaped portion 43 provided in the slider 10. The pivot 41 is actuated by a linear actuator 44, e.g. a solenoid, a jack or the like, and is preferably kept slightly axially offset (FIG. 8) with respect to the axis of its seat 42 for safer holding effect in its locked position.

With this configuration, when the slider 10 is moved against the end 37 of the cylinder 5 towards its working position, after the pivot 41 has been moved backwards from the frustum-shaped seat 43 by the actuator 44, the cap 39 rises automatically, thereby allowing easy insertion of the end 37 into the cradle 36 and then it returns to its locking position, firmly holding in position the cylinder end 37 and therefore the cylinder 5. At the same time, the cradle 31 on the slide 100 engages with the end 34 of the cylinder 4, which is in turn held in its working position.

In the embodiment shown in FIGS. 11 to 14, the holding device or cap 39, instead of rotating about a pivot, can perform a translatory motion so as to be raised when the end 37 moves therethrough in contrast with the force of one or more loading springs 45, which react against an abutment block 46 secured to the slide 10, e.g. by means of bolts 47.

At the rear shoulder 1*a* (FIGS. 1 and 5) a plate-like slide 50 is mounted movable along a lower guide 51 and an upper guide 52 which are entirely similar to the guides 11 and 12. Sliding blocks 20 slide on the upper guides 52. The slide 50 rotatably supports the other end of the sleeve cylinder 5 and can be actuated, similarly to the slide 10, by a motor which, by means of a transmission belt 18, drives a pulley 17 which is keyed to a screw 13 screwed into a female thread 16 secured to the slide. The revolutions of the screw 13 are controlled by an encoder 15.

A slide or sliding block 500, similar to the sliding block 100 on the front shoulder 1*b*, is also provided on the rear shoulder 1*a* and is arranged to move parallel to the side of the slide 50. Its movements are likewise controlled by an electric motor 22 through a transmission comprising a toothed belt 24 and a pulley 25 which is keyed on a screw 26 provided with an encoder 23.

The screws 13 and 26 are preferably high-precision recirculating ballscrews. A pneumatic brake 53 is located axially aligned on each screw is to ensure effective locking in position of the slides.

Figure 6:
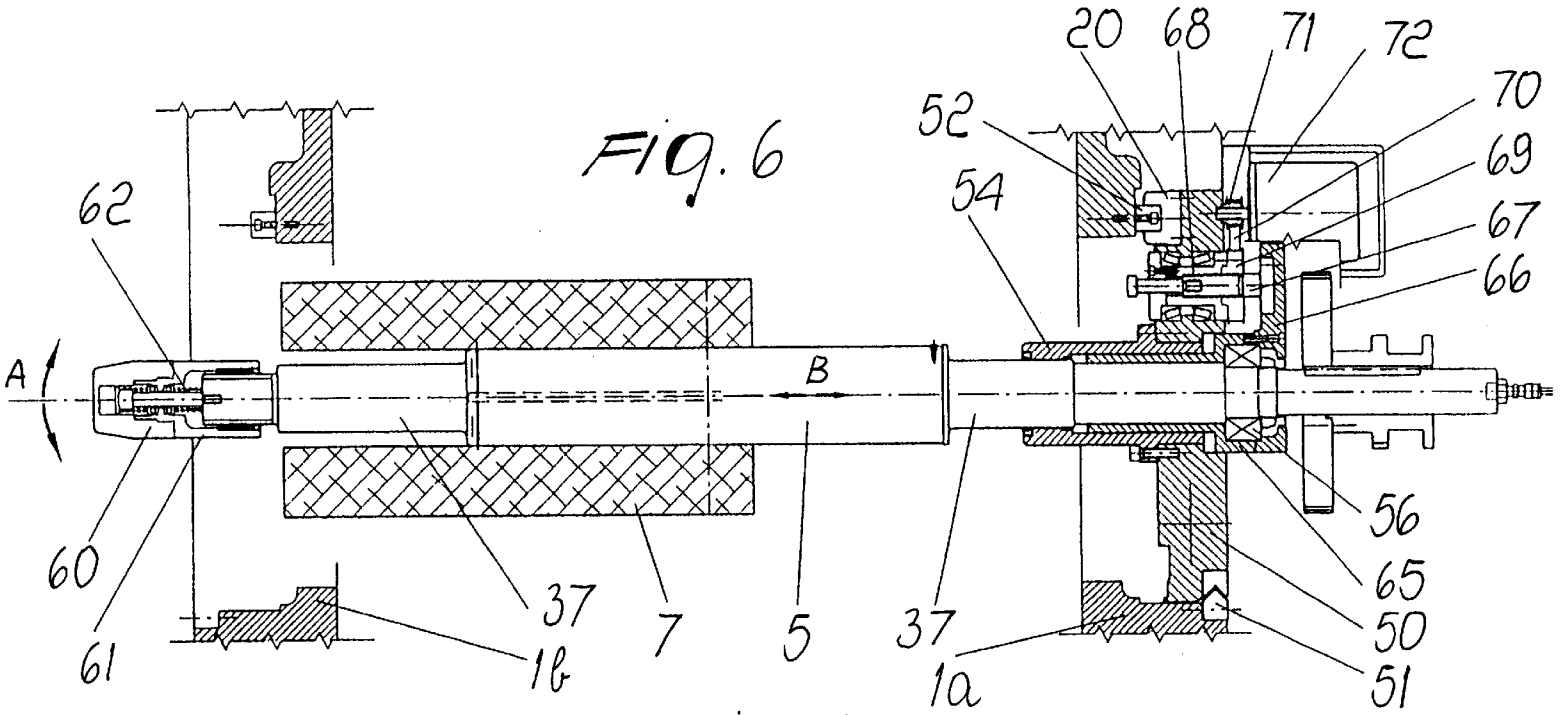
FIG. 6 is a cross-section view taken along the line VI—VI of FIG. 5, and is also an enlarged-scale view of a detail of FIG. 1.

As more clearly shown in FIGS. 1 and 6, the ends 34 and 37 of the cylinders 4 and 5 are mounted on the slide 50 and 500 by means of a respective sleeve 54 and 55 with the interposition of friction reduction means, i.e., bearings 56, whereby allowing its respective cylinder to perform limited angular oscillations (as shown by arrow A in FIG. 6) during sleeve changing operations, and limited longitudinal movements for the necessary transverse alignment of said cylinders (arrow B).

Figure 6A:
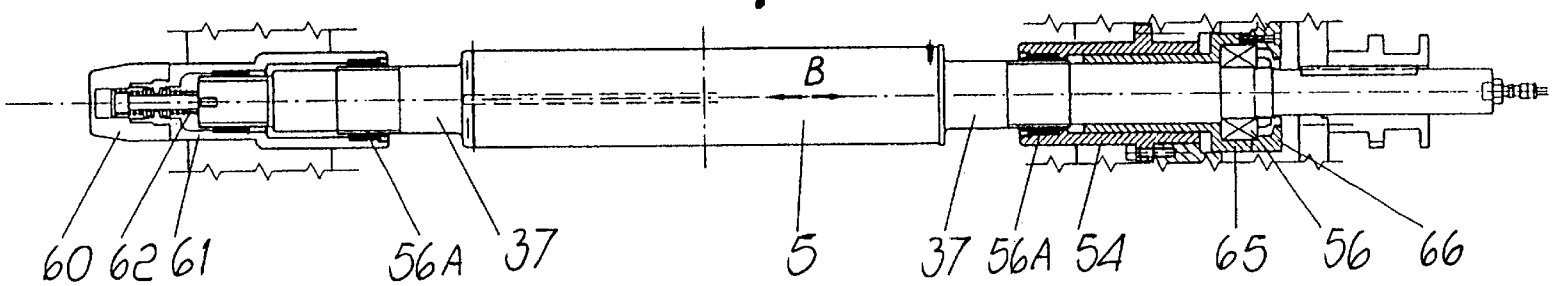
FIG. 6A shows a detail of FIG. 6 according to another embodiment.
Figure 7:
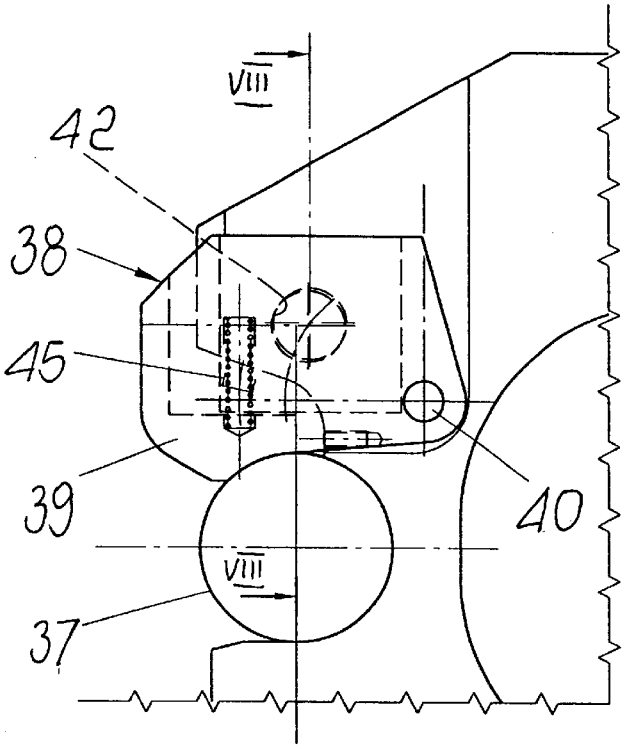
FIG. 7 is a schematic side view of a holding means or cap with a conical locking pin.

In order to minimize the free bending length of the cylinder 5, at the ends 37 of the cylinder 5 two additional roller bearings 56A (see FIG. 6A) can be provided which are seated in the sleeve 54 on one side and in the sleeve 61 on the other side. This arrangement has also the advantage of eliminating angular oscillations indicated by double arrow A in FIG. 6.

FIG. 6 also illustrates the front end of the cylinder 5 which, like the front end 34 of cylinder 4, is provided with a cap 60 which is screwed onto a sleeve 61 for resting on the cradle 36 in the slide 10, the sleeve 61 being loaded by one or more springs 62 for transverse registering movements.

The spring or springs 62 are designed to keep or automatically return the sleeve 61 to its centered position during sleeve changing operations. As more clearly shown in FIG. 6, a second sleeve 65 is slideably mounted inside the sleeve 54 and protrudes from the sleeve 54 with a widened end portion which internally receives the bearings 56.

An oval external flange 66 is fixed to the sleeve 65 and to an acme-thread screw 67 secured to the oval flange 66. The screw 67 can be screwed into a female thread 68 which can be rotated by a toothed pulley 69 which is in turn driven by a toothed belt 70 wound on a driving pulley 71 which is directly rotated by an electric motor 72. By causing the electric motor 72 to turn in one direction or in the other the screw 67 and thus the sleeve 66 and the cylinder 5 are caused to traverse, thereby performing the precision transverse registering of the printing plate cylinder 5.

It will be noted that in a printing machine as described above a very simple, quick and safe change the sleeves 6 and 7 can be performed through the openings 9 with no need of replacing the sleeve cylinders 4 and 5. In practice, it has been found that in a color printing machine according to the invention an average sleeve changing time is on the order of a few minutes, in contrast with color changing time of a few hours required with conventional printing machines.

The above described invention is susceptible of numerous modifications and variations within the scope as defined by the appended claims.

Figure 16:
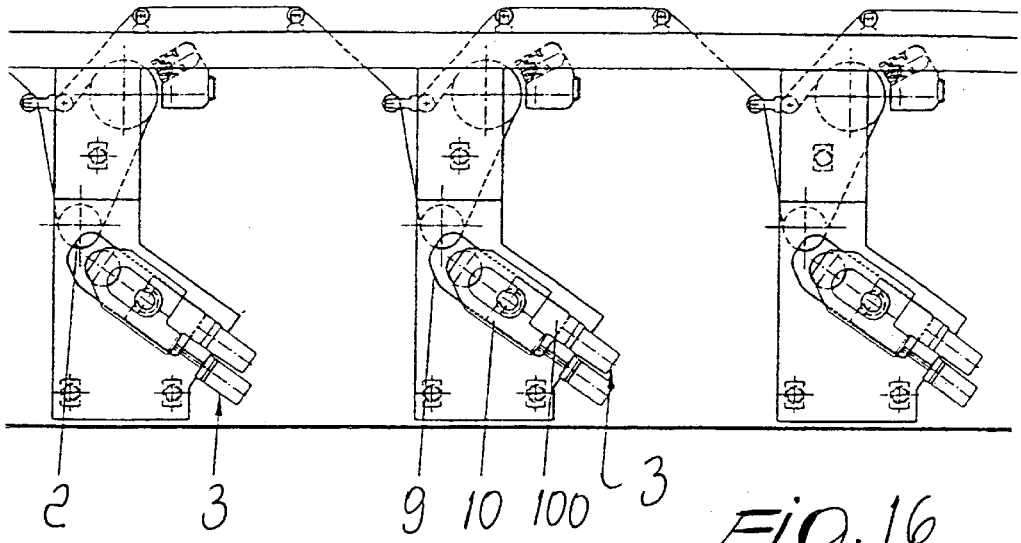
FIGS. 16 and 17 are diagrammatic side elevation views of a printing machine with single in-line colour units, and with twin stacked colour units, respectively.
Figure 17:
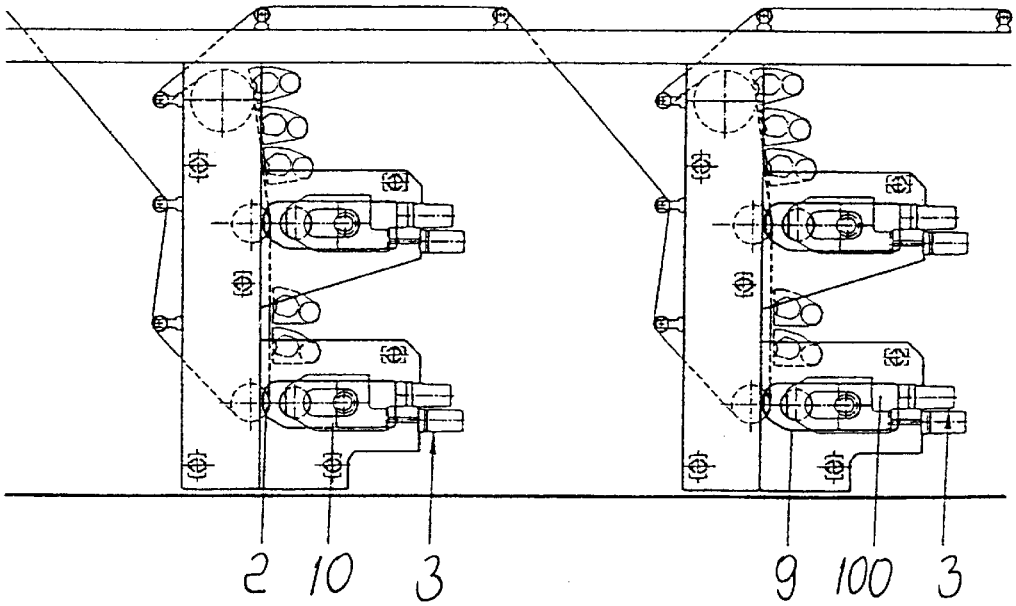

Thus, for example, as shown in FIGS. 16 and 17, the above described embodiment of a printing machine can be applied to printing machines with a central drum (FIG. 15), to printing machines with separate color units (FIG. 16) and to printing machines with twin stacked color units (also known as "stack" machines in the art) see FIG. 17.

The disclosures in Italian Patent Application No. VR98A000037 from which this application claims priority are incorporated herein by reference.

What is claimed is:

1. A temporary engagement device or cap for holding lateral cylinder ends of a rotating cylinder in their working position, in respective cradles, said device comprising a retractable element at an inlet-outlet portion of one of said cradles which is arranged to move between a partly locking position for the inlet-outlet of said cradle and a remote position to allow inlet and outlet exit into and from said cradle and wherein said retractable element has inclined-plane guiding chamfers for sliding engagement with an end of said cylinder.

2. The device according to claim 1, wherein said retractable element comprises a lever which is articulated about a pivot.

3. The device according to claim 1, comprising resilient loading means for said retractable element.

4. The device according to claim 1, comprising at least one recess in said retractable element, at least one movable engagement element arranged to engage a respective said at least one recess, and control means for said at least one engagement element, thereby locking said retractable element in said partly locking position.

* * * * *